United States Patent [19]

Hailey

[11] Patent Number: 4,645,131

[45] Date of Patent: Feb. 24, 1987

[54] POWDER MILLING METHOD TO PRODUCE FINE POWDER SIZES

[76] Inventor: Robert W. Hailey, 2030-229 Beverly Plz., Long Beach, Calif. 90815

[21] Appl. No.: 686,017

[22] Filed: Dec. 24, 1984

[51] Int. Cl.[4] ..... B02C 13/09

[52] U.S. Cl. ..... 241/23; 241/34; 241/67; 241/186.4; 241/189 R; 241/275; 241/DIG. 14

[58] Field of Search ..... 241/275, 189 R, 67, 241/66, 23, 34, DIG. 14, DIG. 37, 186 R, 186.4; 148/125, 126.1

[56] References Cited

U.S. PATENT DOCUMENTS

| | | | |
|---|---|---|---|
| 1,289,542 | 12/1918 | Rapp . | |
| 2,306,665 | 12/1942 | Schwarzkopf . | |
| 2,468,321 | 4/1949 | Bland . | |
| 2,512,523 | 6/1950 | Fisher et al. . | |
| 2,609,993 | 9/1952 | Planiol | 241/DIG. 14 X |
| 3,001,727 | 9/1961 | Block et al. . | |
| 3,184,169 | 5/1965 | Friedman et al. . | |
| 3,670,970 | 6/1972 | Szegvari . | |
| 3,688,991 | 9/1972 | Andrews . | |
| 3,716,196 | 2/1973 | Motek et al. . | |
| 3,744,993 | 7/1973 | Matt et al. . | |
| 3,749,322 | 7/1973 | Reynolds . | |
| 3,788,562 | 1/1974 | Greenlay et al. | 241/275 X |
| 3,921,917 | 11/1975 | Meinass . | |
| 4,015,780 | 4/1977 | Hall . | |
| 4,018,633 | 4/1977 | Holland . | |
| 4,090,874 | 5/1978 | Kaufman . | |
| 4,129,443 | 12/1978 | Kaufman . | |
| 4,239,159 | 12/1980 | Johns . | |
| 4,251,034 | 2/1981 | Corr et al. . | |
| 4,252,577 | 2/1981 | Malard . | |
| 4,273,294 | 6/1981 | Hollely et al. . | |

*Primary Examiner*—Mark Rosenbaum

*Attorney, Agent, or Firm*—William W. Haefliger

[57] ABSTRACT

A method of milling a powdery substance to finer particle size includes impacting the powdery substance against single or multiple surfaces under vacuum conditions and at reduced temperature condition to cause particle fracture, and collecting said fractured particles.

9 Claims, 9 Drawing Figures

POWDER MILLING METHOD TO PRODUCE FINE POWDER SIZES

BACKGROUND OF THE INVENTION

This invention relates generally to powder metallurgy, and more particularly to method and apparatus for making metal powder.

There are major continuing needs in the metals industry for improved, lower cost, high performance alloys of various compositions, including stainless steels, tool steels, maraging steels, super alloys, cobalt and nickel base alloys, titanium alloys, aluminum alloys, copper alloys and others. These needs can be met with new methods and equipment that have been developed to press and consolidate metal powders in a manner that provides improved alloys at lower cost, in controlled shapes.

However, if these new methods are to fully satisfy the needs of industry, they also require improved methods for making metal powders as raw materials to meet the following criteria:

(1) High purity—low impurity content, including oxygen;

(2) Fine particle size—for optimum blending with other powders to homogenous alloy compositions;

(3) Pressable particle forms—suitable for cold pressing to required preform shapes;

(4) Consistent high quality;

(5) Availability-in large quantities;

(6) Availability at low cost—because of high yields from starting material; and minimum processing, labor and energy costs.

Prior apparatus used low temperature milling in air or inert atmospheres to break down scrap metals into powder, with the following problems:

(1) Aerodynamic drag reduces both particle velocity and the efficiency of particle breakdown, especially with high velocity impact milling;

(2) Turbulent gas layers at impacting surfaces prevent or impede penetration of small particles to the impacting surfaces where they can be effectively broken down;

(3) Powder particle surfaces are oxidized during milling unless high purity inert gases are used as a protective atmosphere, which can be costly with some methods;

(4) Standard milling methods generally require extensive milling time or recycling for satisfactory total yields from starting material;

(5) Standard milling methods generally are not satisfactory for producing good yields of fine powders below 20 microns diameter.

(6) The fines from metal powders which are milled in a gas atmosphere can be suspended as a dust in the gas, and increase the problems of aerodynamic drag and cushioning of impact surfaces, causing lower powder breakdown rates as well as environmental and equipment contamination.

Prior apparatus has used high pressure air or gas to propel powders and impact them against hard surfaces at high velocities to break the powders down to finer particle sizes. The disadvantages of such prior art are:

(a) If air is used to drive the powders against an impacting surface, oxidation of freshly fractured surfaces can occur from exposure to the $O_2$ and $H_2O$ in air.

(b) If an inert gas such as $N_2$ is used, a large recovery system is required to separate the gas from the powder after breakdown, and to reclaim the gas for economic re-use (c) Large gas flows are required to generate necessary particle impact velocities for breakdown, and this creates cushioning and turbulent gas layer effects at impacting surfaces that reduce particle impact velocities to give lower breakdown rates and yields, particularly with finer particles.

(d) Overall costs are fairly high because of the energy inefficiencies in compressing and using gases for this type of milling, and because ofpoor yields and the large equipment installations required.

SUMMARY OF THE INVENTION

It is a major object of the invention to provide methods and apparatus to meet the above needs and criteria and to overcome the above described problems and difficulties. The basic method of the invention comprises: milling a powdery substance such as metal particles to finer particle size, and includes impacting said powdery substance against single or multiple surfaces under vacuum conditions and at reduced temperature condition to cause particle fracture, and collecting said fractured particles. Typically, the particles are reduced in size to less than 20 microns in average cross dimension. The impacting step may advantageously include rotating a rotor having certain impacting surfaces, and controllably feeding said powdery substance into the path of said surfaces during rotor rotation. Other surfaces are typically provided generally radially outwardly of the rotating rotor to receive impact thereagainst of particles thrown outwardly by the rotor impacting surfaces, and within a closed chamber which may be maintained under vacuum conditions and at a low temperature, thereby to enhance particle brittleness and promote particle fracture.

Further objects and advantages include feeding the supply particles by gravity into the path of rotor rotation; roller feeding of the powder stream to increase its velocity into the rotor blade path; measurement and control of powder flow rate; the provision of a rotor having impact blade surface curvature to controllably disperse the impacted particle stream; and the use in the particle feed stream of substances selected from the group that includes iron, chromium, titanium, aluminum, copper, zinc, beryllium, and alloys of their metals, ferroalloys, carbides, and other frangible or friable materials needed in fine particle sizes.

Unusual advantages, individually and collectively include the following:

(a) Milling in a vacuum provides a means for efficiently driving metal powder particles at high velocity against an impacting surface, unimpeded by aerodynamic drag forces or gas turbulence effects;

(b) Vacuum milling eliminates gas cushioning and turbulent gas layer effects at impact surfaces to allow a clean, hard impact of powder particles against such surfaces for efficient breakdown in any single impact cycle;

(c) Providing for multiple surface impact gives increased breakdown efficiency in a single impact cycle;

(d) Provision for continuous feed of powder materials for breakdown, and continuous outputto sealed storage containers, without dusting;

(e) Capability for milling materials other than metal powders, including plastics and other materials that are embrittled when cooled to low temperatures, and which would be broken down more effectively by milling in vacuum and at low temperatures;

(f) Provides the means for impacting a thin layer of powder, down to a monolayer, in each impact cycle to give maximum breakdown efficiency;

(g) Prevents undesirable oxidation of particle surfaces because of the absence of $O_2$ or $H_2O$ in the milling environment;

(h) Allows optimum control over system variables such as powder feed rates; rotor speed; powder temperature; target temperature; and impact target positions to give desired breakdown and maximum yields;

(i) Provides for a clean, enclosed operation with minimum dusting problems; and (j) Provides a compact system that uses minimum energy to produce high yields, with a resultant low overall cost.

These and other objects and advantages of the invention, as well as the details of an illustrative embodiment, will be more fully understood from the following description and drawings, in which:

DRAWING DESCRIPTION

DETAILED DESCRIPTION

Figure 1:
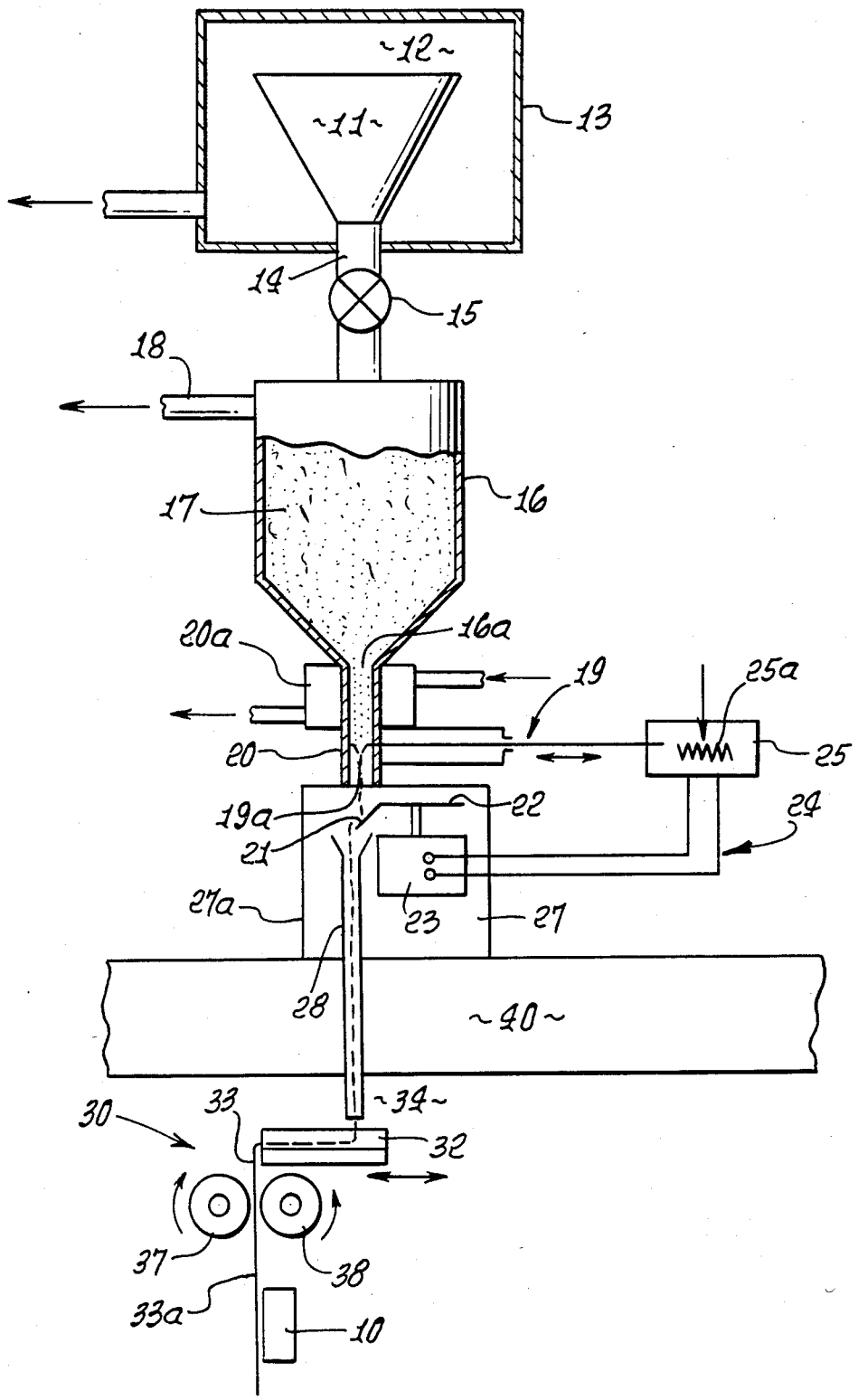
FIG. 1 is an elevation showing apparatus for controllably feeding metal particles in a feed stream to the impacting rotor.

Referring first to FIG. 1, means is provided for supplying a stream of feed particles into the path of a rotating rotor indicated at 78 for milling. Powder particles are fed from an upper charging hopper 11 located in an evacuated zone 12 within an enclosure 13. The particles discharge via duct 14 and control gate valve 15 into a feed hopper 16. Powder therein is indicated at 17. The use of the charging hopper and valve 15 allows discharge from the feed hopper, in vacuum, while the charging hopper is being loaded and space 12 evacuated. Vacuum exhaust is provided by ducts 18.

Apparatus is provided beyond the outlet 16*a* of the feed hopper to control powder flow rates to the rotor 78. Such apparatus may advantageously include a shutter 19 in down flow duct 20, to which powder flows, the position of the shutter controlling the orifice at 19*a* to regulate the flow rate. Duct 20 is cooled as by fluid at 20*a*.

After falling through the orifice, the powder falls against an inclined surface 21 on a weighing platform 22 of an electronic scale 23 (such scales are well known, per se). The signal output of the latter is fed at 24 to a servo control 25 which controls the shutter position. Thus, if the powder flow rate is too high, the scale senses same and causes the servo to decrease the orifice size, and vice versa. An adjustment potentiometer associated with control 25 is indicated at 25*a*, to set a basic flow rate.

The scale is located in an evacuated space 27 in enclosure 27*a*. Powder falls off surface 21 into a duct 28 which passes downwardly through the top section 40 of the milling unit 30, also shown in FIG. 2, and including shell 40*a* and insulation 40*b*. In the form of the invention shown in FIG. 1, the powder falls into a trough 32 which is vibrated and shaped to cause the formation of a controlled width and thickness stream falling at 33 from the trough, in evacuated zone 54. The trough is also cooled to cool the powder stream to a final temperature, as it falls at 33, toward the impacting rotor.

To provide increased rates of powder feed to the rotor blades, so that a greater length of powder stream will be impacted by a rotor blade in each rotor revolution, the powder stream falling from the end of the feed trough is passed between a pair of rollers 37 and 38 above the rotor blade position. The pair of rollers preferably have their longitudinal axes essentially on the same horizontal plane, so that powder passing through the rolls will be directed vertically downward into the path of the impacting rotor blade. The rollers are set for a predetermined gap distance as required for the thickness of powder stream, and may be held in a fixed position or positioned by spring loading to adjust to variations in the powder stream. The rollers' speed of rotation is set so that the desired stream length and thickness and width is delivered to the rotor blade with each revolution of the rotor.

Figure 2:
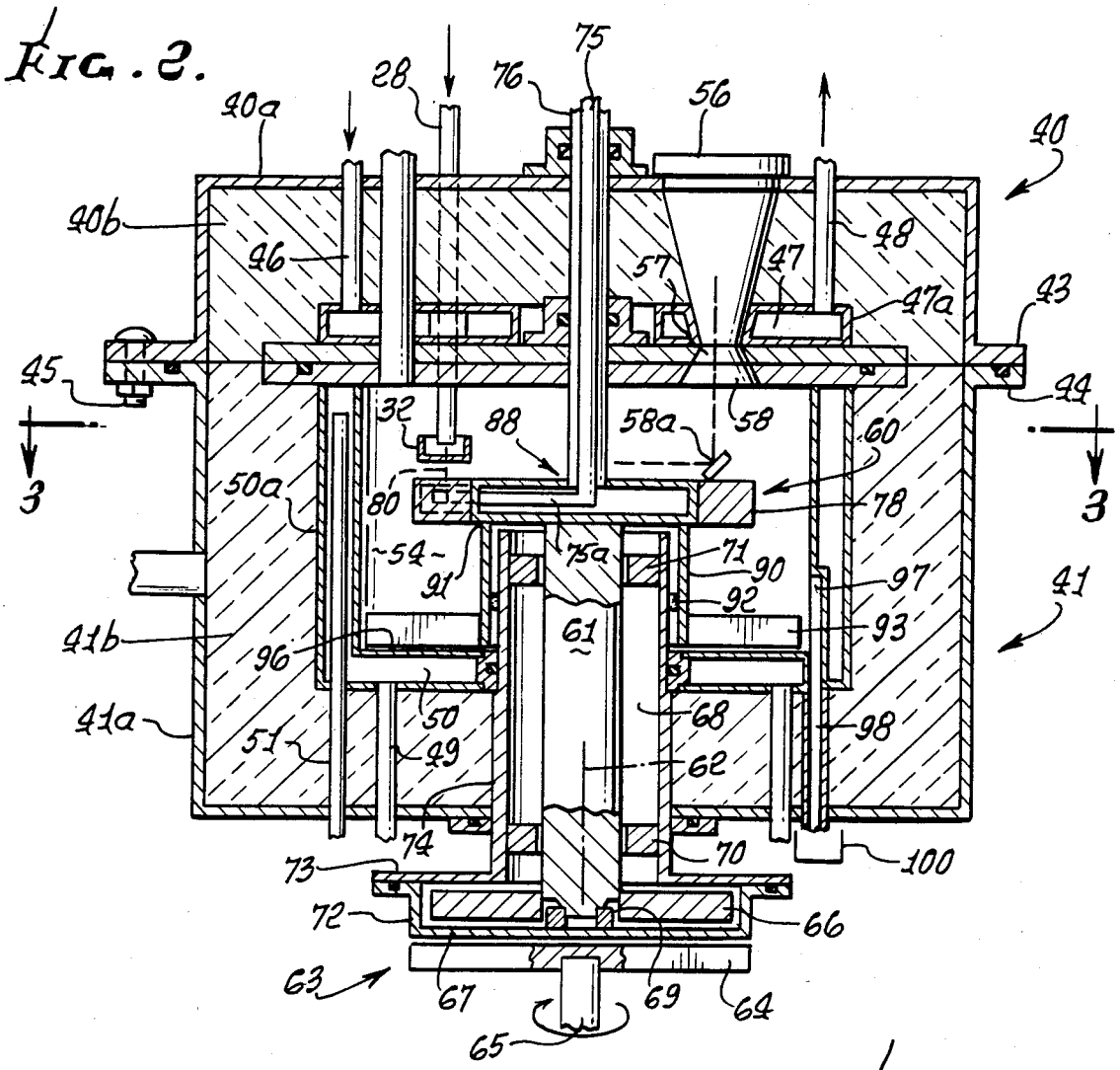
FIG. 2 is an elevation, in section, on lines 2—2 of FIG. 3, showing details of apparatus associated with the particle impacting rotor.
Figure 3:
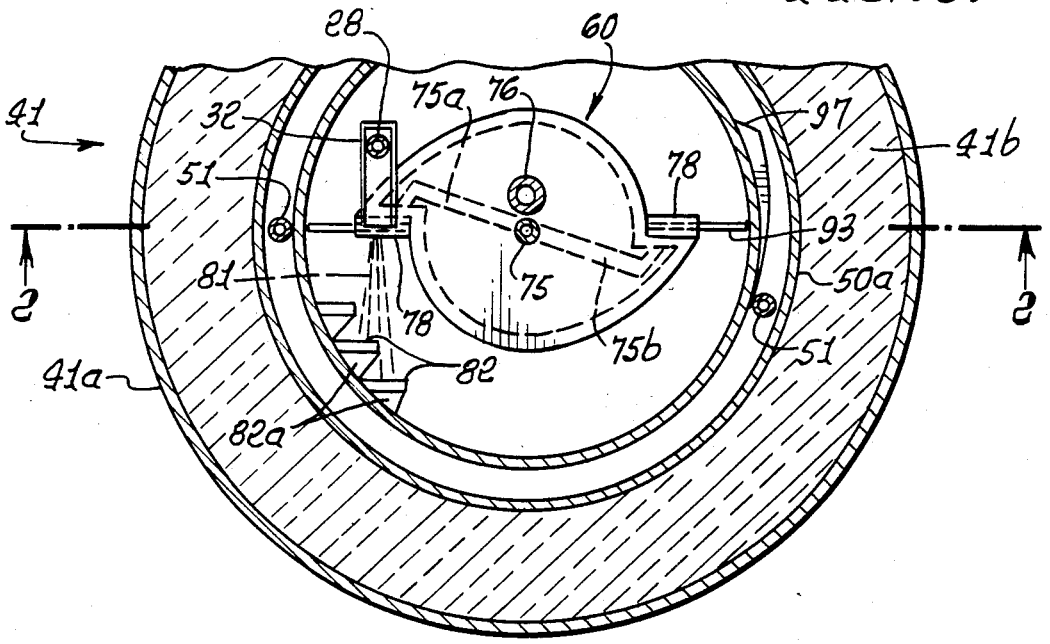
FIG. 3 is a plan view, taken in section on lines 3—3 of FIG. 2.
Figure 4:
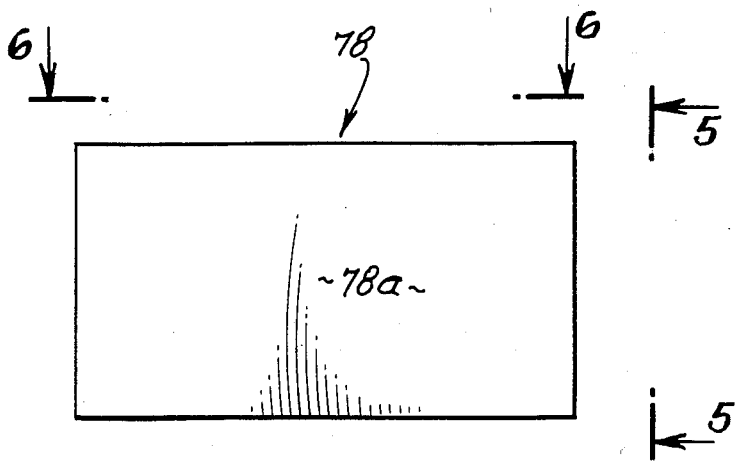
FIG. 4 is a front elevation showing a rotor blade face having cylindrical curvature.
Figure 5:
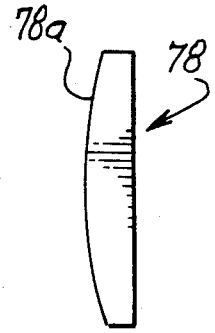
FIG. 5 is a side elevation on lines 5—5 of FIG. 4.
Figure 6:
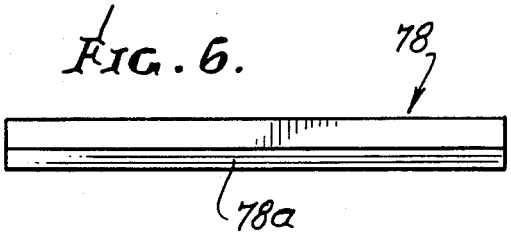
FIG. 6 is a top plan view on lines 6—6 of FIG. 4.
Figure 7:
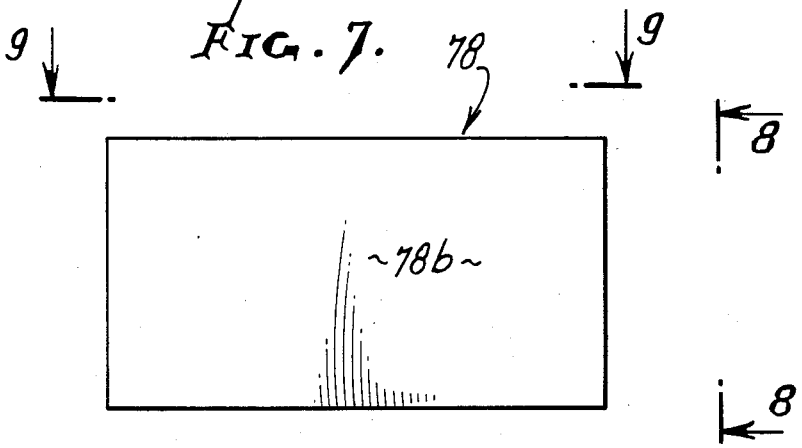
FIG. 7 is a front elevation showing a rotor blade face having spherical curvature.
Figure 8:
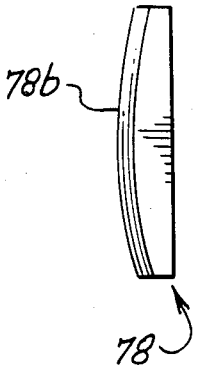
FIG. 8 is a side elevation on line 8—8 of FIG. 7.

Referring now to FIGS. 2 and 3, an outer container shell encloses the entire assembly of milling components. See for example shell upper and lower sections 40*a* and 41*a*, and insulation 40*b* and 41*b*, interfitting at plane 42. Suitable flanges 43 and 44 on the sections may be interconnected as at 45. Coolant passages are shown at 46–48 in the upper section, and at 49–51 in the lower section. Passages 47 and 50 may be formed by auxiliary enclosures 47*a* and 50*a*. The powder is delivered downwardly, via the feed tube 28 to trough 32 referred to above, within evacuated space or zone 54 cooled to a low temperature, as for example −100° F., as by coolant flowing within passage 50. Sealed glass viewing ports may be provided, as shown at 56–58 and positioned for viewing the falling powder (see for example, mirror 58*a*).

The rotor 60 is mounted on shaft 61 rotated about a vertical axis 62, as by drive apparatus 63. The latter may include a magnetic drive arm or plate 64 suitably driven at 65 outside the sections 40 and 41; and a driven magnetic arm or plate 66, inside the wall 67 associated with section 41. Thus arm 66 is rotated in the evacuated space 68. Bearings appear at 69–71, and other wall structure at 72–74. The rotor is cooled via coolant lines 75 and 76, which may for example be rotated with the rotor.

FIGS. 3 and 4–8 show the impact blades 78 of the rotor, rotated at high velocity as for example between 2,000 and 20,000 RPM, at, for example between 4 and 24 inches radius from the rotor axis.

Figure 9:
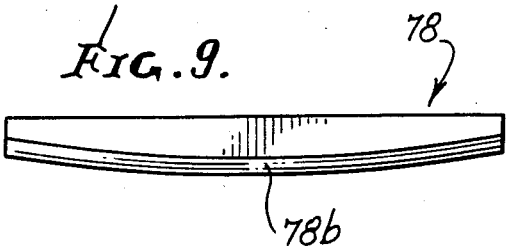
FIG. 9 is a top plan view on lines 9—9 of FIG. 7.

The blades 78 are mounted at a desired angle and are designed for convenient replacement of worn rotor blades. The rotor blades are of high hardness materials, such as cobalt base alloys, metal carbides, and tungsten with maximum wear resistance and high thermal conductivity, and with a low friction coefficient and low cold bonding tendencies relative to the powders being impacted against the blades during milling. The blades may be held rigidly or against a spring loaded or resilient backing, the latter allowing minor elastic give of the blade with each impact cycle, which can improve breakdown of some materials. The blades may be shaped on their impacting surfaces with a slight cylindrical or spherical curvature, to provide a controlled dispersion of the powder stream against the target plates, and to allow a thicker powder stream to be fed to the rotor blades. See for example the cylindrical surface 78*a* in FIGS. 4–6, and the spherical impact surface 78*b* in FIGS. 7–9. Broken lines 80 and 81 respectively indicate the path of powder particle flow into the path of the blades, and the path of fractured particle flow radially toward the outer and stationary impact surfaces 82. The particles are further broken up upon striking surfaces 82.

Target plates 82 are the secondary impacting surfaces against which the powder is driven for breakdown, and are characterized by:

(a) The plates may be singles or multiples for an individual powder feed station, but provide a full target area, horizontally and vertically for the powder mass driven from the rotor blades in a thin layer of controlled height and width.

(b) The plates 82 can be positioned at angles to deflect the powder stream toward discharge and out of the way of succeeding powder masses from following rotor blade impacts.

(c) Multiple target plates provide for a larger target area within a given I.D. of the inner wall of enclosure 50*a*, so as to give a shorter average length of powder mass travel between rotor impact and target impact.

(d) The plates are preferably designed for convenient replacement in side member brackets 82*a* of the inner shell, when they are worn.

(e) Target plates 82 preferably consist of high hardness materials such as cobalt base alloys, metal carbides and tungsten of high density and with compositions that give maximum wear resistance, and minimum friction and cold-bonding tendencies relative to powder particles impacting the plate surfaces, and with high thermal conductivity to allow efficient cooling.

(f) Target plates can be cooled separately to a lower temperature than the inner shell by cooling their side member brackets with a flow of liquid coolant such as liquid $N_2$ for the purpose of enhancing particle brittleness and breakdown during impact.

Referring again to the cooling means, it may be characterized by:

(1) Use of a rotor top plate structure hollow at 147, with a high thermal conductivity and with the hollow body extended out behind the rotor impacting blade positions, to give maximum cooling to the rotor blades.

(2) Fixing a vertical tube structure 88 to the center of the rotor top plate, which extends down into the hollow rotor plate and also up through vacuum seals in the inner and outer shells, to the outside.

(3) Running a coolant feed line 75 down through the vertical tube 88 so that coolant can be fed to the internal areas of the rotor top plate, primarily those that are directly in back of the rotor blade positions, for the purpose of maintaining the lowest possible rotor blade temperature. See ducts 75*a* and 75*b* in FIGS. 2 and 3.

(4) Providing for return flow of the coolant at 76 which can be done through another line in the vertical tube 88 or through the annulus between an inner tube and the outer vertical tube (note that a reverse arrangement can be used for the feed and return flow).

(5) Using a liquid coolant such as refrigerated acetone or liquid $N_2$ that can be continuously recooled and/or recycled.

(6) The rotor top plate also may be cooled in a simple, though less effective way, by positioning a hollow disc form of chamber above the rotor plate; cooling the chamber with a liquid coolant such as liquid $N_2$; and cooling the rotor plate by heat transfer through a thin, resilient, low friction, high thermal conductivity pad such as a precompressed tungsten fiber pad, which is placed between the rotor and the cooled chamber and held in place under light pressure.

A cylindrical dust shroud 90, which is slightly larger in diameter than the rotor housing, is joined at 91 to the bottom of the rotor plate to be concentric with the rotor axis and to extend down around the rotor housing 74 to help prevent fine powders from entering the interior of the rotor housing, to prevent bearing problems. A soft flexible fiber mat seal ring 92 or other means may be used between the rotor housing and the shroud to further block particle movement to the rotor housing interior.

Sweeper blades 93 are attached to the bottom of the cylindrical dust shroud and close to or lightly contacting the bottom 96 of the inner shell, with a sweeping edge of thin metal sheet or flexible fibers or other means, and angled to continuously sweep the milled powder toward the powder discharge ports 97 in the bottom of the inner shell as the sweeper blades rotate with the rotor. Product falls in duct 98, that communicates ports 97 to the exterior.

In summary, as the impacted powder particles are deflected from the target plate, preferably at a slight downward angle, they fall by gravity to the bottom of the inner shell, where the sweeper blades drive them by centrifugal action toward the discharge ports in the inner shell, where they then fall into an attached evacuated storage container, as indicated at 100.

The storage container is connected to the inner shell discharge port with valving which allows continued milling while a full storage container is removed, and while an empty storage container is being attached and evacuated to receive a following load of milled powder.

An individual milling unit can be designed to have up to four feed stations, or more, that operate simultaneously to give maximum milling capacity, with the number primarily dependent on the size and power and cooling capacity of the milling unit.

I claim:

1. The method of milling a powdery metallic substance to finer particle size, that includes impacting said powdery substance against multiple surfaces under vacuum conditions and at reduced temperature conditions to cause particle fracture, said particles being reduced in size by fracturing to under 20 microns in average cross dimension, said impacting including rotating a rotor having certain impacting peripheral surfaces, and controllably feeding said powdery substance downwardly into the path of said surfaces during rotor rotation, and cooling the rotor to low temperature during rotation thereof by passing coolant therein, and collecting said fractures particles; carrying out said impacting to spread apart the particles as they are thrown outwardly by the rotor impacting surfaces toward and against other impacting surfaces, and positively accelerating the downward feed of said particles into the path of rotation of said certain impacting surfaces.

2. The method of claim 1 that includes allowing impacted and fractured particles to fall, and rotatably sweeping the particles to travel in a path for collection and storage.

3. The method of claim 1 wherein said powdery substance is selected from the group that consists essentially of iron, chromium particles and alloys thereof.

4. The method of claim 1 which includes carrying out said impacting in a zone within a closed chamber, and maintaining said zone under said vacuum conditions.

5. The method of claim 1 wherein said impacting is carried out at reduced temperature conditions sufficient to enhance the brittleness of said substance and cause particle fracture.

6. The method of claim 1 which includes providing said rotor impacting surfaces with convex curvature.

7. In apparatus for milling a powdery metallic particulate to finer particle size, the combination that comprises (a) first means for impacting said powdery particulate against at least one surface under vacuum conditions and at lowered temperature, thereby to cause particle fracture, the fractured particles being less than about 20 microns in average cross dimension, (b) said first means including a rotating rotor having a certain impacting surface which is forwardly convex and there being other means for feeding said particulate into the path of said rotor surface, (c) there being a chamber forming an evacuated zone containing said impacting means, and including coolant passages in said chamber for cooling said zone, and other impacting surfaces exposed toward said rotor to receive impact of the particles thrown outwardly by said rotor, said other surfaces also cooled by coolant in said passages, and there being a coolant passage in the rotating rotor for cooling same, (d) and means collecting said fractured particles, (e) said other means including roller means for accelerating the feed of said particulate into the path of said rotor forwardly convex impacting surface.

8. The combination of claim 7 wherein said other means comprises feed hopper structure, a delivery duct from said feed hopper, a shutter controlling the size of an orifice in said duct, and means to sense the flow rate of particulate past said orifice, and to control said shutter in response to said sensing, thereby to control said flow rate.

9. The combination of claim 8 wherein said other means also includes a trough receiving said particulate that flows past the orifice, the trough delivering said particulate to travel in the path of said rotating impacting surface or surfaces of the rotor.

* * * * *